United States Patent [19]

Lova

[11] 4,044,461

[45] Aug. 30, 1977

[54] DEVICE FOR THE MECHANICAL INSERTION OF CURSORS ONTO OPEN SLIDE FASTENERS, ALREADY APPLIED ON GARMENTS

[75] Inventor: Angelo Lova, Vigevano (Pavia), Italy

[73] Assignee: Manifattura Magni Dante & C., S.p.A., Pavia, Italy

[21] Appl. No.: 631,169

[22] Filed: Nov. 11, 1975

[51] Int. Cl.[2] ..... A41H 37/06; B21D 53/50; B29D 5/00

[52] U.S. Cl. ..... 29/768; 29/409

[58] Field of Search ..... 29/207.5 R, 207.5 ST, 29/207.5 SL, 207.5 D, 207, 200 J, 200 P, 408, 409, 410, 768

[56] References Cited

U.S. PATENT DOCUMENTS

| | | | |
|---|---|---|---|
| 3,789,487 | 2/1974 | Kawakami | 29/207.5 SL |
| 3,902,235 | 9/1975 | Kawakami | 29/207.5 SL |
| 3,945,103 | 3/1976 | Fujisaki | 29/207.5 SL |

*Primary Examiner*—Francis S. Husar
*Assistant Examiner*—John S. Brown
*Attorney, Agent, or Firm*—Stevens, Davis, Miller & Mosher

[57] ABSTRACT

Device for the mechanical insertion of cursors onto slide fasteners already applied on garments, where means for handling of slide fastener cursor and means for pulling the ends of the both belts building the slide fastener along said cursor are foreseen.

4 Claims, 6 Drawing Figures

FIG. 2
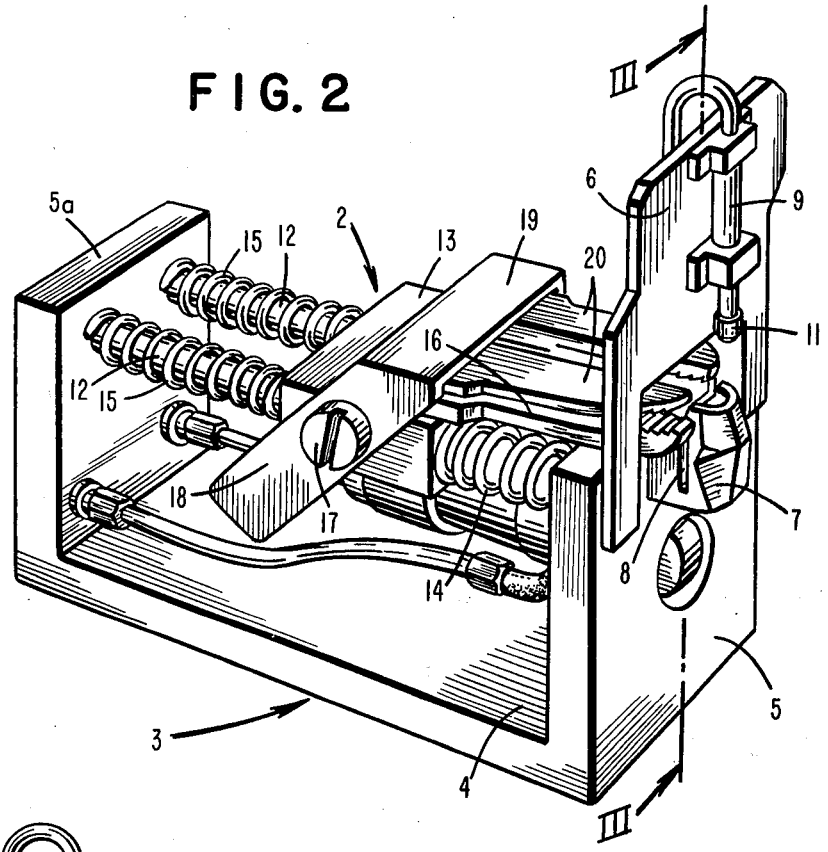
FIG. 6
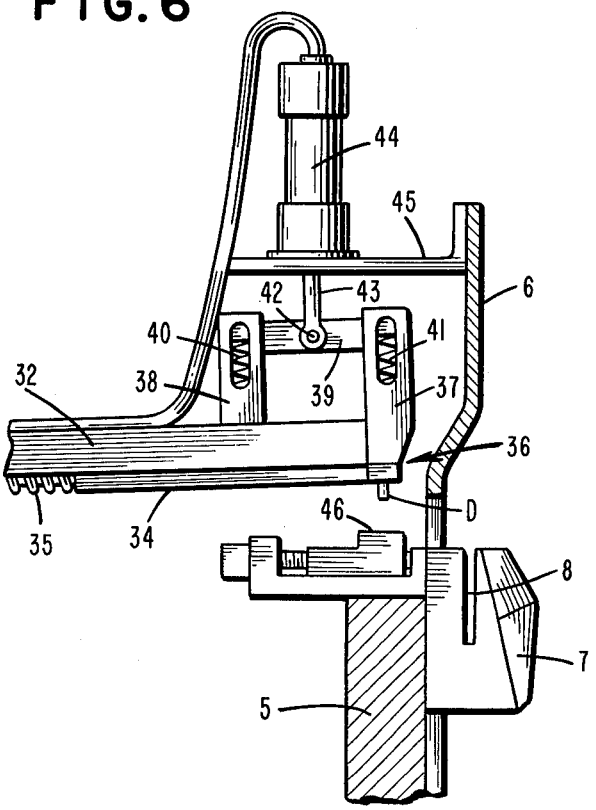
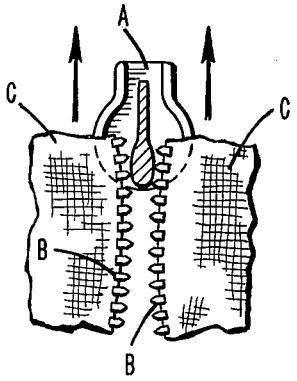
FIG. 4

DEVICE FOR THE MECHANICAL INSERTION OF CURSORS ONTO OPEN SLIDE FASTENERS, ALREADY APPLIED ON GARMENTS

This invention relates to a device for the insertion of cursors onto open slide fasteners, already applied on garments.

It is known, that during standard production of certain garments to which slide fasteners are attached, it is preferable to apply to the clothing pieces the two belts which carry the two series of slide fastener teeth before inserting the cursor on the two parts of the slide fastener to effect the connection of the parts.

In this case the cursor is inserted in correspondence with the rear end of the slide fastener which always has to be closed.

To avoid passing the cursor over the limit point during opening and thereby loose the cursor from the slide fastener, the last teeth of the slide fastener are locked either by metallic staples in the case of metallic slide fasteners or by welding of two or more teeth in case of slide fasteners of plastic material.

The insertion of cursors onto slide fasteners already applied on garments was effected heretofore by hand-with extreme difficulty by the personnel, whose fingers after such strains are subject to weakness and other anomalies.

This invention has the purpose to avoid these irregularities by a device to effect the mechanical insertion of the cursor on the two parts of slide fasteners already sewn on garments avoiding operator's muscle strains and enabling a remarkable increase in the hourly output.

Another purpose of this invention is a device comprising a carrying structure applied on a table with two parallel vertical plates, one of which carries an upper extension having an opening therein, a formed interchangeable element, applied on the front plate of the structure in correspondence with the opening of the extension, capable of receiving and supporting the single cursors to be inserted, a pressing element controlled by a fluid pressure cylinder applied vertically on the extension of the front plate so that the drive of above said cylinder determines the locking of the cursor in its support and a pair of parallel grippers, placed in two sides of the cursor support to catch the ends of the two belts of the slide fastener to draw them backwards and to engage two series of teeth in the cursor. The grippers are carried by a slide plate on longitudinal guides between the two vertical plates of the structure and controlled by another fluid pressure cylinder.

Further features and advantages of this invention are mentioned in the following detailed description with the enclosed drawings as example not restricted, wherein:

FIG. 2 is a perspective view in larger scale of the device;

FIG. 4 is a schematic view for illustration of insertion of the cursor in the slide fastener;

FIG. 6 is a lateral view in elevation in large scale for a detail of FIG. 5.

Figure 1:
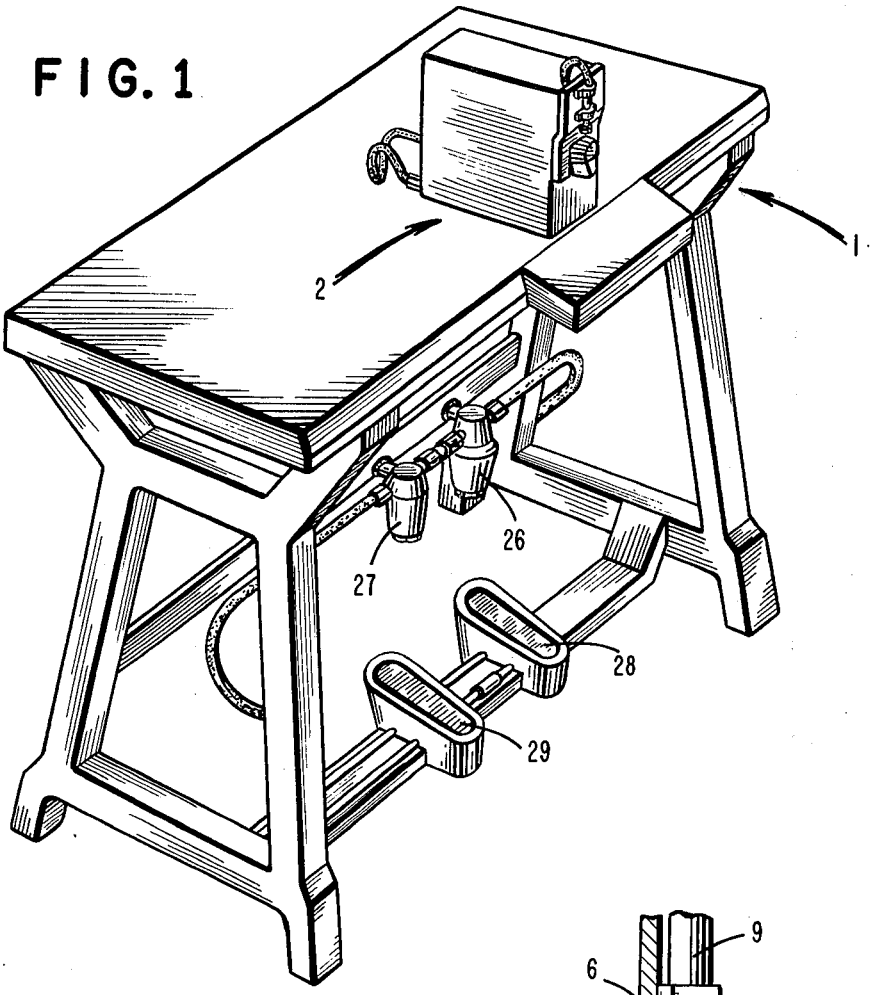
FIG. 1 is a perspective view of a device according to the invention applied on a working table.

With reference to FIG. 1, there is shown a working table 1, on the upper plane of which is applied a device 2 according to the invention for the insertion of cursors on slide fasteners already applied on garments.

Figure 3:
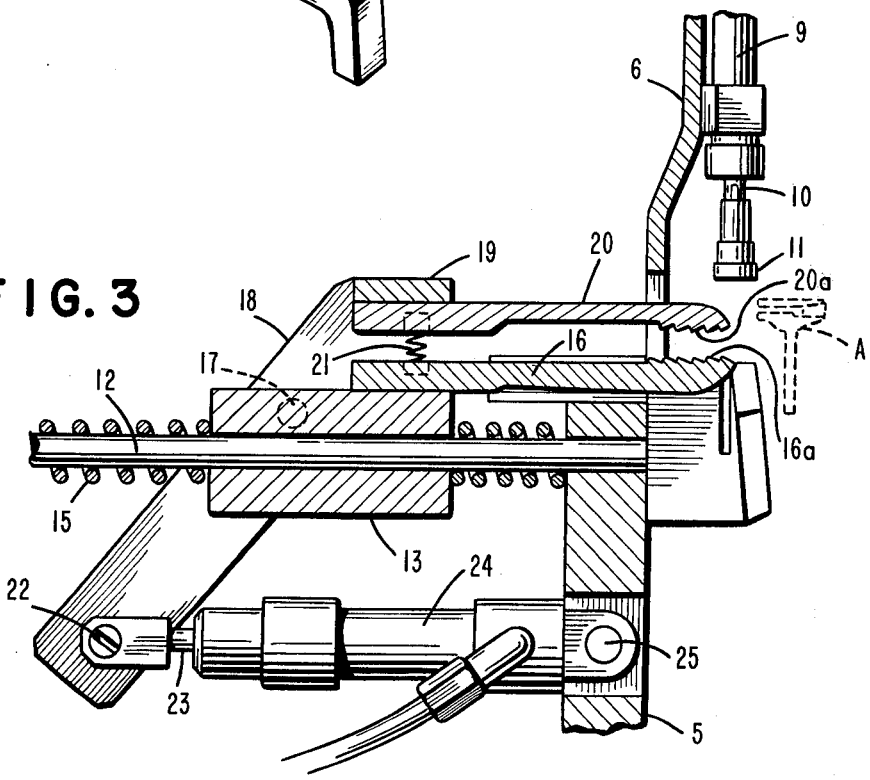
FIG. 3 is an axial portion, represented according to the line III—III of FIG. 2.

As illustrated in FIGS. 2 and 3 the device according to the invention is comprising a carrying structure 3 consisting of a base plate 4 and two vertical end plates 5, 5*a* which are projecting upwards. The front plate 5 carries an upper extension 6 having an opening therein. In the opening of the extension 6 is a supporting element 7, formed to receive and support the cursors to be applied. This element 7 has a groove 8 in the rear where the swing handgrip of the cursor is housed.

The above mentioned element can be easily replaced by other elements appropriate for the form of the cursors to be applied.

On the extension 6 is fixed vertically a fluidpressure cylinder 9 to which is attached a shaft 10. On shaft 10 is applied a pressing element 11 which during lowering locks the cursor on the support 7 during the insertion.

Between the two vertical plates 5, 5*a* of the carrying structure there are two parallel cylindrical guides 12 on which is mounted plate 13. Guides 12 are provided with two series of springs 14 and 15.

On the sides of plate 13 are pivoted two swing levers 18 at transversal pivots 17 with upper ends of levers 18 being bound by a cross beam 19.

From plate 13 project two parallelly formed elements 16 with front ends 16*a* provided with teeth to form the lower jaws of two grippers located on the two sides of the block cursor-holder 7.

Connected to cross beam 19 are two elements 20 projecting in the direction of elements 16 with front ends 20*a* provided with teeth to form the upper jaws of the above said grippers.

Cross beam 19 is biased upwardly by a spring 21 positioned between each set of elements 16 and 20 for lifting the upper jaws of said grippers.

The lower ends of swing levers 18 are connected by a trasversal pin 22 on which is articulated shaft 23 of another fluid pressure cylinder 24 pivoted on an horizontal pin 25 placed on a mounting of front plate 5.

The operation of the described device is as follows: At the beginning a cursor A is placed in the mounting of block 7 and then by actuating a pedal 28 for excitation of an electrovalve 26 some fluid is conveyed under pressure sure to the upper cylinder 9 causing the lowering of pressing element 11 which maintains the cursor locked.

Then to the cursor are brought the two belts C carrying the two series of teeth B of the slide fastener, so that the ends of belts C are in touch with the grippers.

Second pedal 29 is then actuated to cause the excitation of another electrovalve 27 and thereby permit fluid under pressure to be conveyed to cylinder 24 which causes the oscillation in clockwise direction (FIGS. 3 and 5) of swing levers 18.

Initially the oscillation of levers 18 causes the closing of the upper jaws 20*a* on the lower jaws 16*a*, to clamp the grippers on belts C carrying the teeth of the slide fastener.

Figure 5:
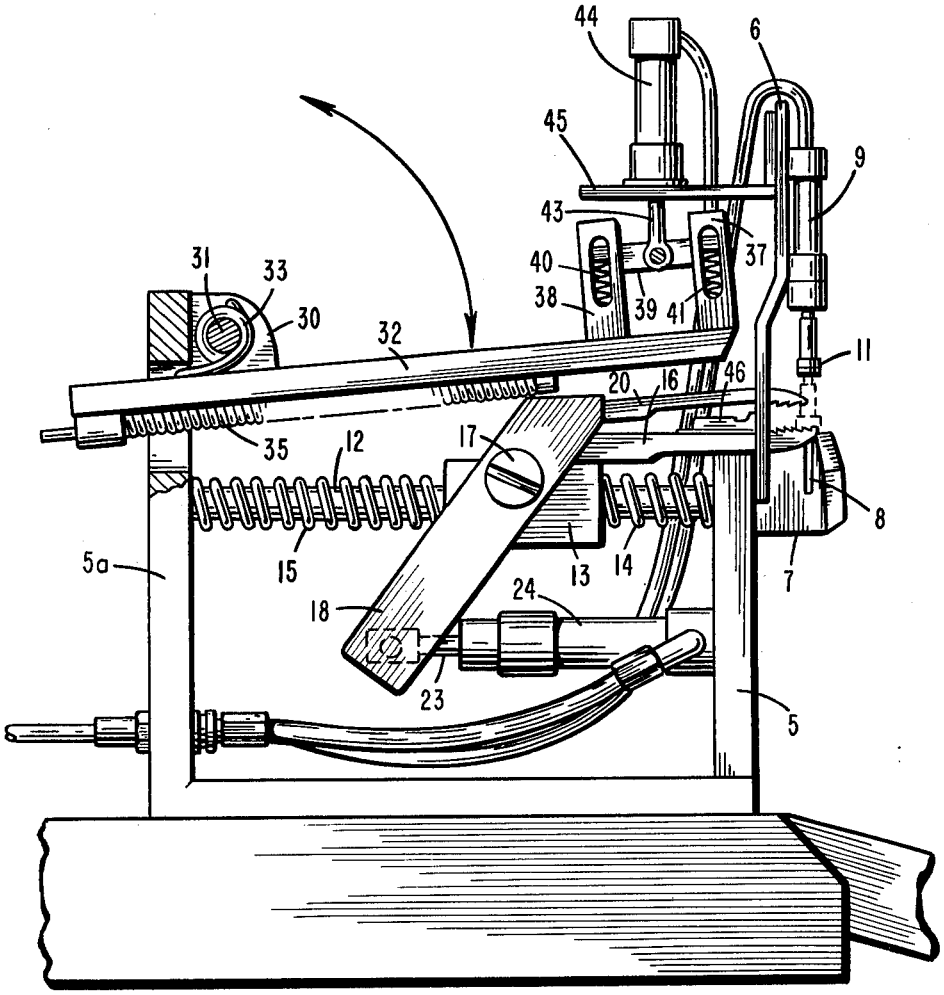
FIG. 5 is a lateral view of the device according to a modification.

After the clamping the further displacement of shaft 23 of cylinder 24 causes the sliding of plate 13 backwards or to the left in FIGS. 3 and 5 and the backing of both grippers thereby pulling belts C to engage the teeth B of the slide fasteners in the cursor.

A displacement of a few millimeters is sufficient to effect the insertion of a cursor onto the slide fasteners.

By releasing pedals 28 and 29 the cylinders come back to the rest position and the garments can be withdrawn from the device.

FIGS. 5 and 6 illustrate a modification which can effect the placing of a metallic staple D in the rear end of the slide fastener.

For this modification vertical plate 5*a* carries two mountings 30 to house a transversal pin 31 supporting a longitudinal rod 32 held up by a torsion spring 33.

On the end of rod 32 opposed to spring 33 on the bottom thereof is placed a carrier 34 for metallic staples. A spring 35 biases the metallic staples towards an opening in the end of rod 32.

The foremost metallic staple of the carrier is pushed towards the slide fastener by cursor 36, housed in vertical casing 37 carried by rod 32.

Parallel to casing 37 is another hollow casing 38. In the interiors of both casings 37 and 38 slide the ends of longitudinal rod 39 held up by springs 40, 41 and pivoted centrally by pin 42 on shaft 43 of a fluid pressure cylinder 44 supported by a platform 45 carried by extension 6.

Actuation of cylinder 44 lowers the swing unit to the location on the slide fastener where the metallic staple is to be applied. The slide fastener is supported by an adjustable clamping device 46 which successfully causes the insertion of the metallic staple onto the slide fastener.

The driving of cylinder 44 can be effected by an appropriate hand control or by an automatic control deriving from the movement of the grippers. The stapling unit can be replaced by a welding group.

It is self evident that the device can effect in a mechanical way with less difficulty the same operations formerly executed by hand and with a higher output.

Of course, according to this invention the execution and the construction details can be widely varied according to the above said description without going out from the field of this invention.

I claim:

1. Device for mechanical insertion of a cursor onto a slide fastener composed of two belts carrying teeth already applied to garments, comprising a carrying structure to be applied on a table consisting of front and rear parallel vertical plates, said front plate having an extension which carries an opening therein, a block cursor support applied on said front plate of said structure in correspondence with the opening of the extension to receive and support the cursor to be inserted, a first fluid pressure cylinder positioned on said extension, a pressing element controlled by said fluid pressure cylinder so that the driving of the cylinder determines the locking of the cursor in its support, a pair of parallel grippers having upper and lower jaws placed on both sides of the cursor support to grasp the ends of the two belts of the fastener to draw them backwards and to engage the two series of teeth in the cursor, longitudinal guides extending between said two vertical plates of the structure, a slide plate carried by said guides, the lower jaws of said grippers being carried by said slide plate and a second fluid pressure cylinder having a shaft positioned on said front plate to operate said grippers.

2. The device according to claim 1, including two swing levers pivotable laterally to said slide plate, a cross beam connecting said two swing levers at upper ends thereof, a transversal pin connecting lower ends of said swing levers, said two upper jaws projecting from said cross beam, said shaft of the second fluid pressure cylinder being pivotable on said pin so that the first part of the expansion stroke of said cylinder causes the closing of the jaws and the clamping of the same onto the belts carrying the teeth of the slide fastener and the successive part of the stroke of the shaft causes the backward movement of the slide plate and of both grippers to draw the belts through the cursor and permit insertion of the cursor on the teeth of the slide fastener.

3. The device according to claim 2 including electrovalves and foot pedals connected thereto to control fluid flow to said pressure cylinders.

4. The device according to claim 1, including means to lock two opposite teeth in the rear end of the slide fastener after the insertion of the cursor, said means comprising a third fluid pressure cylinder and a swing rod carried by said third fluid pressure cylinder, the driving of said cylinder first lowering the rod and second locking said teeth.

* * * * *